US010066830B1

(12) United States Patent
Knight

(10) Patent No.: US 10,066,830 B1
(45) Date of Patent: Sep. 4, 2018

(54) LIGHTED LINEMAN PLIERS

(71) Applicant: Anthony Knight, Central Islip, NY (US)

(72) Inventor: Anthony Knight, Central Islip, NY (US)

(73) Assignee: UNIQUE Electrical Concepts & Designs Inc.

( * ) Notice: Subject to any disclaimer, the term of this patent is extended or adjusted under 35 U.S.C. 154(b) by 0 days.

(21) Appl. No.: 15/731,793

(22) Filed: Aug. 2, 2017

(51) Int. Cl.

| | |
|---|---|
| ***F21V 33/00*** | (2006.01) |
| ***B25B 7/08*** | (2006.01) |
| ***B25G 1/10*** | (2006.01) |
| ***F21V 23/04*** | (2006.01) |
| *F21Y 115/10* | (2016.01) |

(52) U.S. Cl.
CPC ..... *F21V 33/0084* (2013.01); *B25B 7/08* (2013.01); *B25G 1/102* (2013.01); *F21V 23/04* (2013.01); *F21Y 2115/10* (2016.08)

(58) Field of Classification Search
CPC ..... F21V 33/0084; B25B 7/08; B25G 1/102
USPC ..... 362/119
See application file for complete search history.

(56) References Cited

U.S. PATENT DOCUMENTS

| | | | | |
|---|---|---|---|---|
| 9,789,597 | B2 * | 10/2017 | West | B25D 1/12 |
| 2015/0196998 | A1 * | 7/2015 | Crawford | B25B 23/18 362/119 |

FOREIGN PATENT DOCUMENTS

| | | | | |
|---|---|---|---|---|
| CN | 103538000 A | * | 1/2014 | B25B 7/22 |
| CN | 107511774 A | * | 12/2017 | B25B 7/22 |

* cited by examiner

*Primary Examiner* — Toan Ly

(57) ABSTRACT

An illuminating device that replaceably attaches to a lineman pliers used in a work area and selectively illuminates the work area of the lineman pliers. The lineman pliers include a pair of opposing handles, a pair of opposing jaws, and a pivot. The illuminating device includes a mounting assembly and an illuminating assembly. The mounting assembly replaceably receives the pair of opposing handles of the lineman pliers. The illuminating assembly is integrally attached to the mounting assembly and selectively illuminates the work area of the lineman pliers.

16 Claims, 7 Drawing Sheets

LIGHTED LINEMAN PLIERS

BACKGROUND OF THE INVENTION

Field of the Invention

The embodiments of the present invention relate to a lighted pliers, and more particularly, the embodiments of the present invention relate to an illuminating device for replaceably attaching to a lighted lineman pliers used in a work area and for illuminating the work area of the lighted lineman pliers.

Description of the Prior Art

Numerous innovations for tool lights have been provided in the prior art, which will be described, infra, in chronological order to show advancement in the art, and which are incorporated herein in their entirety by reference thereto. Even though these innovations may be suitable for the specific individual purposes to which they address, however, they differ from the embodiments of the present invention.

U.S. Pat. No. 5,678,919 to Huang

U.S. Pat. No. 5,678,919—issued to Huang on Oct. 21, 1997—teaches illuminating scissors including a pair of blades pivotally joined in an intermediate portion thereof by a bolt engaged with a hexagonal lock nut and each having a handle at an end thereof, a cylindrical housing mounted on one of the blades, a light bulb arranged in a cylindrical edge of the cylindrical housing, a battery fitted in the cylindrical housing and electrically connected with the light bulb, a switch mounted on the cylindrical housing and electrically connected with the battery and the light bulb, and a linking rod having a first end connected with the housing and a second end connected with one of the blades, whereby the illuminating scissors will direct light onto the cutting surface.

U.S. Pat. No. 5,921,654 to Coyle

U.S. Pat. No. 5,921,654—issued to Coyle on Jul. 13, 1999—teaches a manual gripping tool with an illuminated gripping end allowing the user to find and manipulate small objects in close and dark environments. An illumination source on the gripping end of the tool illuminates objects in the close environment, allowing the user to see the desired object for manipulation. One preferred use is to recover lost objects that might have fallen or otherwise become lodged in the close environment.

U.S. Pat. No. 6,296,365 to McCalla et al.

U.S. Pat. No. 6,296,365—issued to McCalla et al. on Oct. 2, 2001—teaches a lighted hand tool, such as, a lighted plier tool. The tool includes first and second plier members and a light source. Each plier member has a handle portion, a jaw portion, and a pivot section being intermediate the handle portion and the jaw portion for each plier member. The second plier member is pivotally mounted relative to the pivot section of the first plier member at the pivot section of the second plier member for being pivotable relative to the first plier member. The handle portion of the first plier member defines a bore longitudinally extending along at least a portion of the length of the handle portion. The bore has a bore front end near the first pivot section. The light source is disposed within the bore of the handle portion, adjacent the bore front end, and is capable of producing a beam of light. Thus, the light source is energized from a power apparatus. The beam of light produced by the light source is in communication with at least one portion of the first and the second plier members.

United States Patent Application Publication Number 2007/0291474 to Hui

United states patent application publication number 2007/0291474—published to Hui on Dec. 20, 2007—teaches an illumination source for illuminating the jaws of a handheld tool near the tool's working tip. At least one LED is mounted on a handheld tool so that when energized the LED light encircles the tips of the tool's jaws and illuminates the working surface. The illumination source may be permanently integrated with the tool or may be retrofit. A power source and a switch are provided to energize the LEDs. The power source may, or may not, be serviceable. If the working environment is corrosive or otherwise hazardous, the entire illumination source may be sealed to prevent sparks or corrosion of the internal parts.

U.S. Pat. No. 7,399,101 to Clausen et al.

U.S. Pat. No. 7,399,101—issued to Clausen et al. on Jul. 15, 2008—teaches a lighted plier hand tool apparatus including a pivoting hub device containing a first opening, an opposed second opening, and a passage therethrough extending from the first opening to the second opening. The plier hand tool apparatus further includes a first plier member and a second plier member. Each plier member includes a respective handle portion, a jaw portion, and an intermediate pivot portion therebetween. Each respective pivot portion defines a respective bore section formed for aligned receipt of the hub device therein. This receipt interconnects the first and the second plier members together to enable relative pivotally movement of the respective jaw portions at a work area between an opened condition and a closed condition. The hand tool apparatus further includes an illumination device having an illumination portion outputting a light beam from one end of an elongated body section. The body section of the assembly is formed and dimensioned for receipt in the passage of the hub device, so that the illumination portion terminates at the work area for illumination thereof.

Chinese Patent Application Publication Number CN104440646

Chinese patent application publication number CN104440646—published on Mar. 25, 2015—teaches multifunctional pliers, and relates to the field of industrial machines. The multifunctional pliers include a pliers' head and pliers' handles. A rotating shaft is arranged between the pliers' head and the pliers' handles. An LED lamp is arranged on one pliers' handle. The lamp head of the LED lamp and the pliers' head face the same direction. A switch is arranged on the LED lamp. The LED lamp enables people to still normally use the pliers under the dark environment to bring more convenience to the people. The pliers' head and the pliers handles' are made of an aluminum alloy material, and the aluminum alloy is high in strength and difficult to corrode, so that the service life of the pliers can be prolonged.

U.S. Pat. No. 9,157,629 to Brauner et al.

U.S. Pat. No. 9,157,629—issued to Brainier et al. on Oct. 13, 2015—teaches a lighted hand tool including a cylindrical-shaped rivet member, and a first and a second tool member, each having a handle, a jaw, and a pivot portion therebetween. A cylindrical bore section is defined by each pivot portion. Each bore is in co-axial alignment for aligned receipt of the rivet member therein. The rivet member prevents lateral separation of the first and the second hand tool therebetween, while enabling pivotal movement of the jaw portions. An illumination device is formed for sliding receipt in the receiving channel of the rivet member, and aligns an output portion with the communication port to illuminate the work area. A first end cap and a second cap are treatably disposed in the opposite openings into the rivet member. The first and the second end cap cooperate to securely abut and seat the illumination device therebetween.

It is apparent that numerous innovations for tool lights have been provided in the prior art that are adapted to be used. Furthermore, even though these innovations may be suitable for the specific individual purposes to which they address, however, they would not be suitable for the purposes of the embodiments of the present invention as heretofore described.

SUMMARY OF THE INVENTION

Thus, an object of the embodiments of the present invention is to provide an illuminating device for replaceably attaching to a lineman pliers used in a work area and for illuminating the work area of the lineman pliers, which avoids the disadvantages of the prior art.

Briefly stated, another object of the embodiments of the present invention is to provide an illuminating device that replaceably attaches to a lineman pliers used in a work area and selectively illuminates the work area of the lineman pliers. The lineman pliers include a pair of opposing handles and a pair of opposing jaws. The illuminating device includes a mounting assembly, an illuminating assembly, and a pivot. The mounting assembly replaceably receives the pair of opposing handles of the lineman pliers. The illuminating assembly is integrally attached to the mounting assembly and selectively illuminates the work area of the lineman pliers.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

BRIEF DESCRIPTION OF THE FIGURES OF THE DRAWING

The figures of the drawing are briefly described as follows.

LIST OF REFERENCE NUMERALS UTILIZED IN THE FIGURES OF THE DRAWING

Introductory

Figure 1:
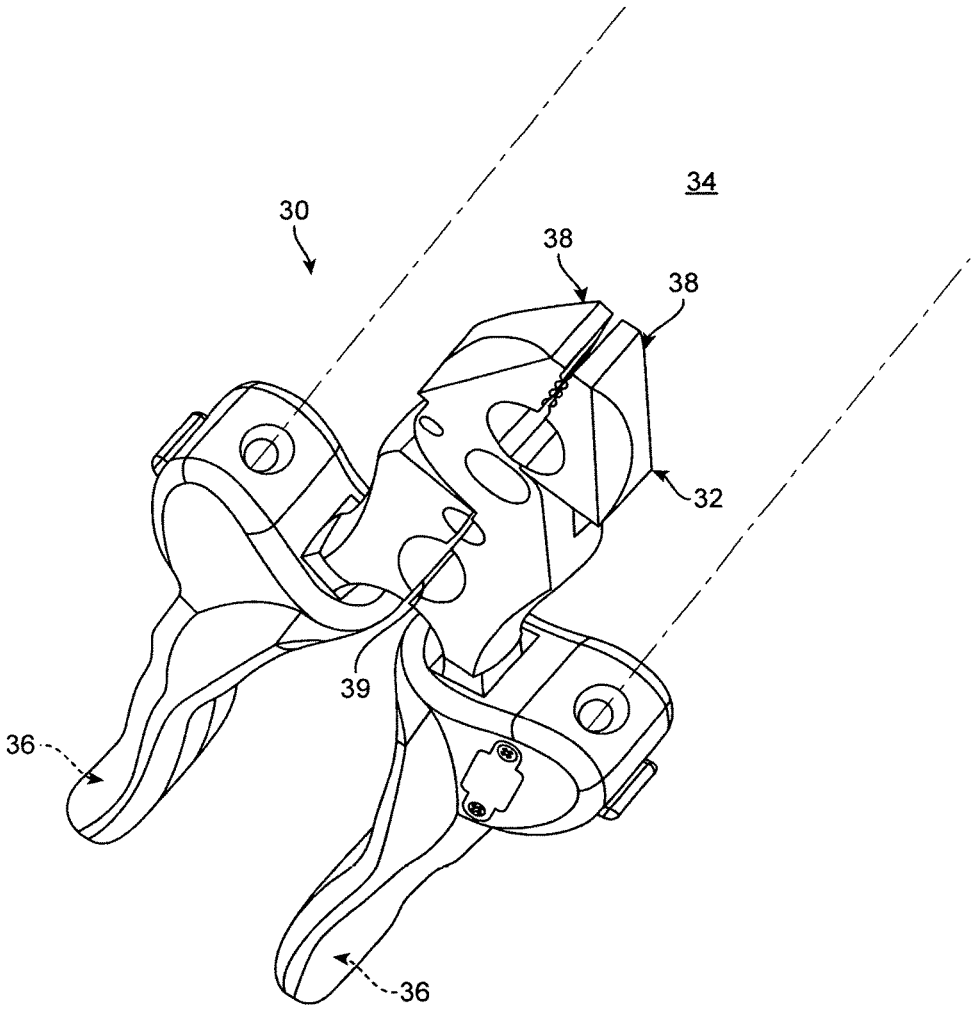
FIG. 1 is a diagrammatic perspective view of the illuminating device of the embodiments of the present invention replaceably attaching to a lineman pliers used in a work area and selectively illuminating the work area of the lineman pliers.
Figure 2:
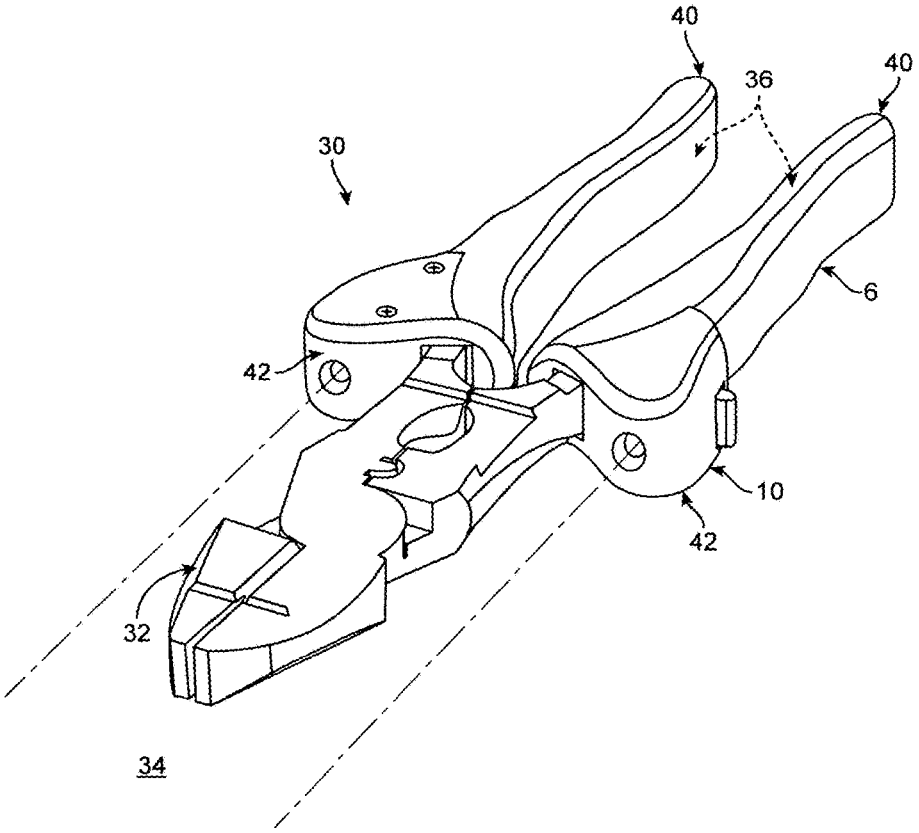
FIG. 2 is a diagrammatic perspective view of the illuminating device of the embodiments of the present invention replaceably attaching to a lineman pliers used in a work area and selectively illuminating the work area of the lineman pliers.
Figure 3:
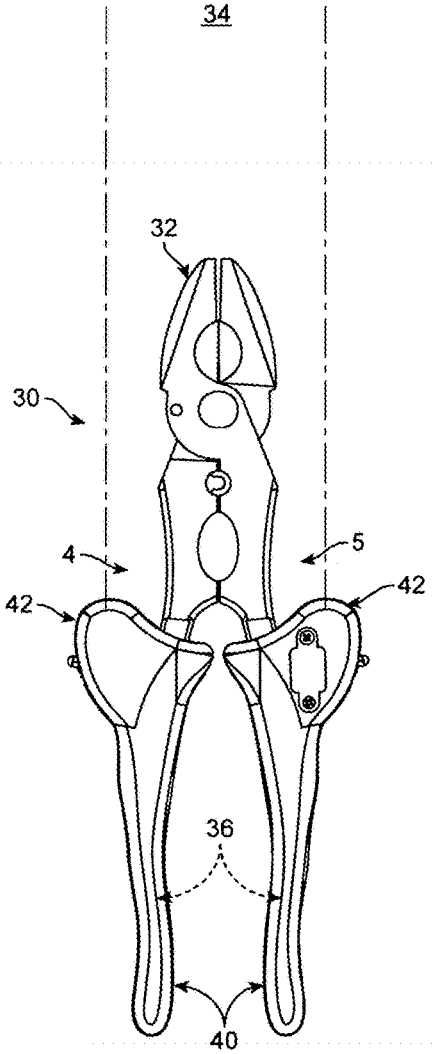
FIG. 3 is a diagrammatic front elevational view of the illuminating device of the embodiments of the present invention replaceably attaching to a lineman pliers used in a work area and selectively illuminating the work area of the lineman pliers.
Figure 4:
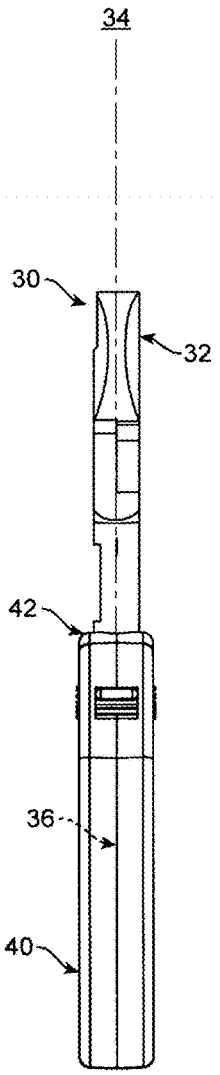
FIG. 4 is a diagrammatic side elevational view taken in the direction of ARROW 4 in FIG. 3 of the illuminating device of the embodiments of the present invention replaceably attaching to a lineman pliers used in a work area and selectively illuminating the work area of the lineman pliers.
Figure 5:
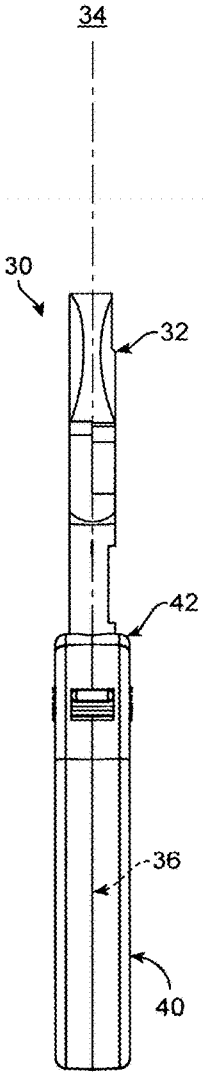
FIG. 5 is a diagrammatic side elevational view taken in the direction of ARROW 5 in FIG. 3 of the illuminating device of the embodiments of the present invention replaceably attaching to a lineman pliers used in a work area and selectively illuminating the work area of the lineman pliers.
Figure 6:
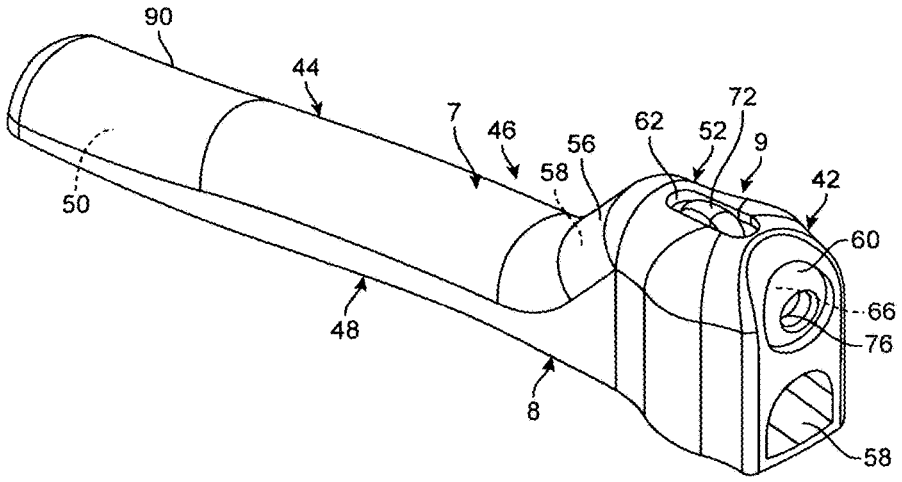
FIG. 6 is an enlarged diagrammatic perspective view of the grip of the mounting assembly of the illuminating device of the embodiments of the present invention identified by ARROW 6 in FIG. 2.
Figure 7:
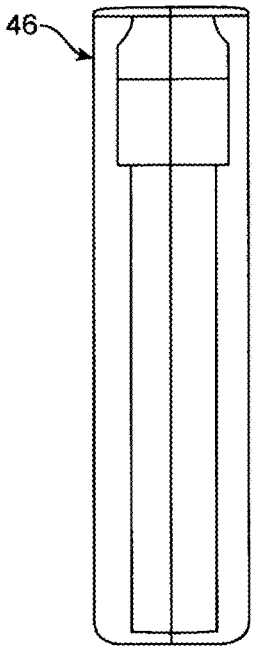
FIG. 7 is a diagrammatic outside elevational view of the grip of the mounting assembly of the illuminating device of the embodiments of the present invention identified by ARROW 7 in FIG. 6.
Figure 8:
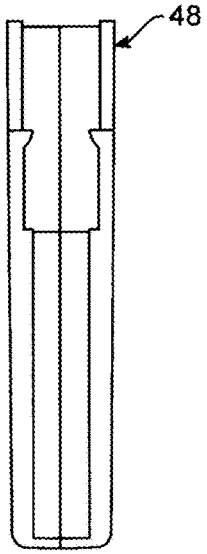
FIG. 8 is a diagrammatic inside elevational view of the grip of the mounting assembly of the illuminating device of the embodiments of the present invention identified by ARROW 8 in FIG. 6.
Figure 9:
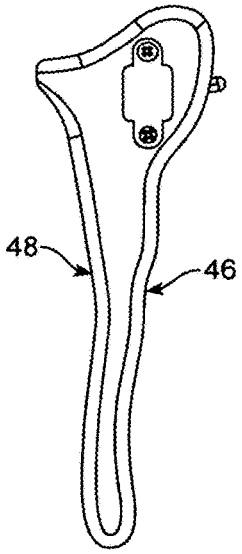
FIG. 9 is a diagrammatic front elevational view of the grip of the mounting assembly of the illuminating device of the embodiments of the present invention identified by ARROW 9 in FIG. 6.
Figure 10:
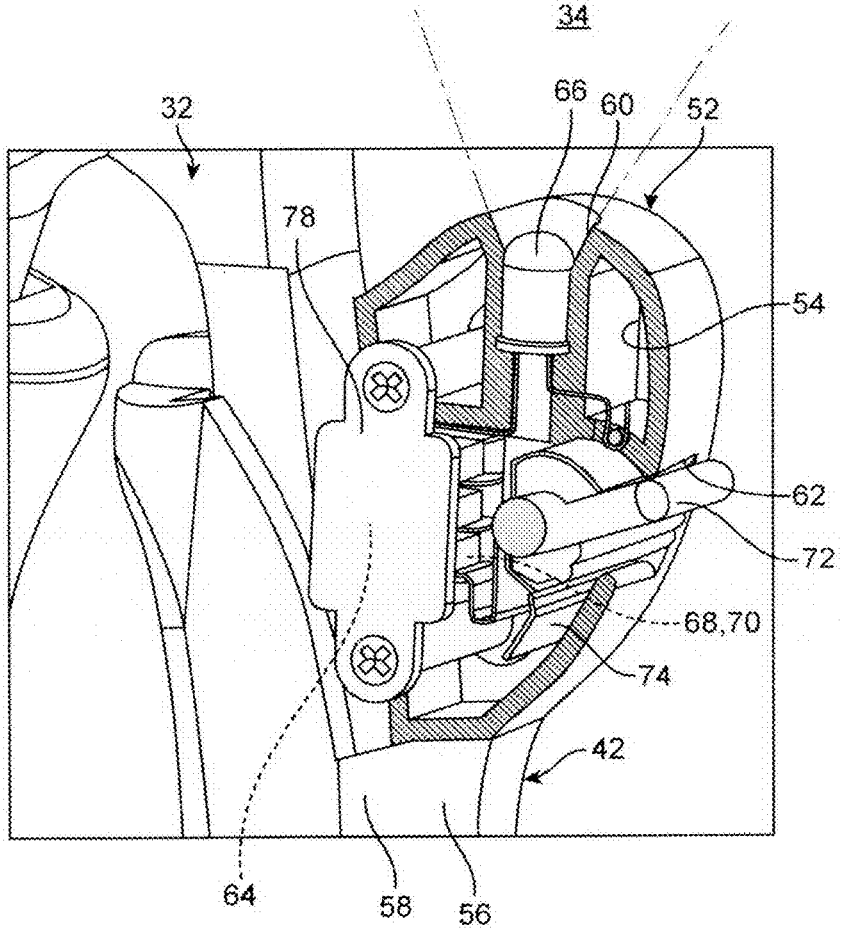
FIG. 10 is an enlarged diagrammatic perspective view of the illuminating assembly of the illuminating device of the embodiments of the present invention identified by ARROW 10 in FIG. 2.
Figure 11:
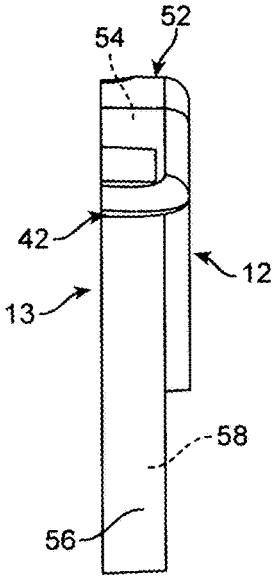
FIG. 11 is a diagrammatic side elevational view of the illuminating assembly of the illuminating device of the embodiments of the present invention.
Figure 12:
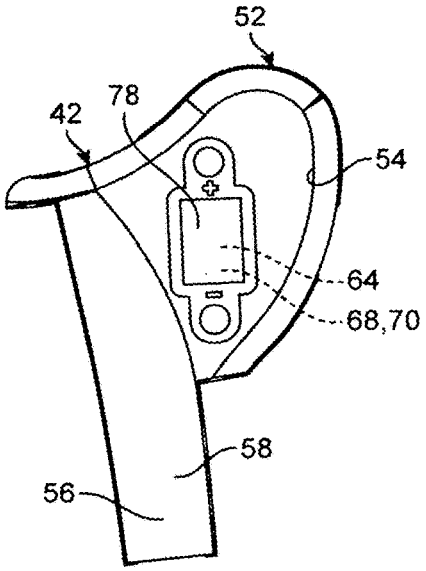
FIG. 12 is a diagrammatic front elevational view of the illuminating assembly of the illuminating device of the embodiments of the present invention identified by ARROW 12 in FIG. 11.
Figure 13:
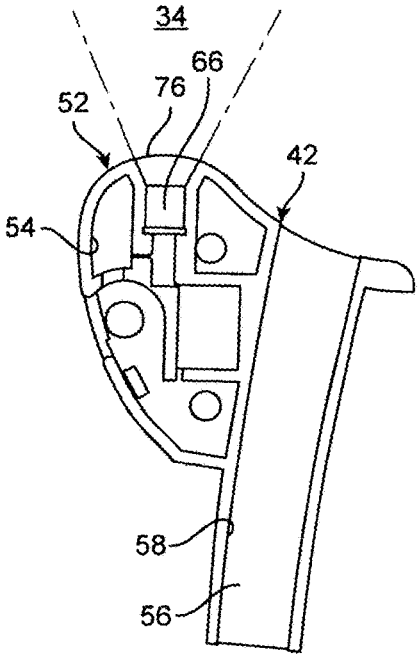
FIG. 13 is a diagrammatic rear elevational view of the illuminating assembly of the illuminating device of the embodiments of the present invention identified by ARROW 13 in FIG. 11.

30 illuminating device of embodiments of present invention for replaceably attaching to lineman pliers 32 used in work area 34 and for selectively illuminating work area 34 of lineman pliers 32

32 lineman pliers

34 work area of lineman pliers 32

36 pair of opposing handles of lineman pliers 32

38 pair of opposing jaws of pair of lineman pliers 32

39 pivot of pair of lineman pliers 32

Overall Configuration of Illuminating Device 30

40 mounting assembly for replaceably receiving pair of opposing handles 36 of lineman pliers 32

42 illuminating assembly for selectively illuminating work area 34 of lineman pliers 32

Specific Configuration of Mounting Assembly 40

44 pair of grips of mounting assembly 40 for conformingly fitting when pair of handles 36 of lineman pliers 32 is received thereby, respectively.

46 outside portion of each grip of pair of grips 44 of mounting assembly 40

48 inside portion of each grip of pair of grips 44 of mounting assembly 40

50 sleeve of each grip of pair of grips 44 of mounting assembly 40 for conformingly receiving associated handle of pair of handles 36 of lineman pliers 32

Specific Configuration of Illuminating Assembly 42

52 pair of housings of illuminating assembly 42

54 compartment of each housing of pair of housings 52 of illuminating assembly 42

56 mount of each housing of pair of housings 52 of illuminating assembly 42

58 sleeve of mount 56 of each housing of pair of housings 52 of illuminating assembly 42

60 upper LED bore of each housing of pair of housings 52 of illuminating assembly 42 for aiming towards work area 34 of lineman pliers 32

62 side switch bore of each housing of pair of housings 52 of illuminating assembly 42

64 front battery bore of each housing of pair of housings 52 of illuminating assembly 42

66 LED of compartment 54 of each housing of pair of housings 52 of illuminating assembly 42 for aiming towards work area 34 of lineman pliers 32

68 power source interface of compartment 54 of each housing of pair of housings 52 of illuminating assembly 42 for receiving battery 70 for selectively powering LED 66 of compartment 54 of associated housing 52 of illuminating assembly 42

70 battery for selectively powering LED 66 of compartment 54 of associated housing 52 of illuminating assembly 42

72 switch of compartment 54 of each housing of pair of housings 52 of illuminating assembly 42

74 snap plate of compartment 54 of each housing of pair of housings 52 of illuminating assembly 42

76 lens cover of compartment 54 of each housing of pair of housings 52 of illuminating assembly 42

78 battery plate of compartment 54 of each housing of pair of housings 52 of illuminating assembly 42

DETAILED DESCRIPTION OF THE PREFERRED EMBODIMENTS

Introductory

Referring now to the figures, in which like numerals indicate like parts, and particularly to FIG. 1, the illuminating device of the embodiments of the present invention is shown generally at 30 for replaceably attaching to a lineman pliers 32 used in a work area 34 and for selectively illuminating the work area 34 of the lineman pliers 32. The lineman pliers 32 include a pair of opposing handles 36, a pair of opposing jaws 38, and a pivot 39.

Overall Configuration of the Illuminating Device 30

The overall configuration of the illuminating device 30 can best be seen in FIGS. 2-5, and as such, will be discussed with reference thereto.

The illuminating device 30 comprises a mounting assembly 40 and an illuminating assembly 42. The mounting assembly 40 is for replaceably receiving the pair of opposing handles 36 of the lineman pliers 32. The illuminating assembly 42 is integrally attached to the mounting assembly 40 for selectively illuminating the work area 34 of the lineman pliers 32.

Specific Configuration of the Mounting Assembly 40

The specific configuration of the mounting assembly 40 can best be seen in FIGS. 6-9, and as such, will be discussed with reference thereto.

The mounting assembly 40 comprises a pair of grips 44. Each grip 44 of the mounting assembly 40 is slender and elongated for proper fitting when an associated handle 36 of the lineman pliers 32 is received thereby. Each grip 44 of the mounting assembly 40 has an outside portion 46, an inside portion 48, and is made from ABS rubber.

The outside portion 46 of each grip 44 of the mounting assembly 40 is attached to the inside portion 48 of an associated grip 44 of the mounting assembly 40 by glue so as to form a sleeve 50 therebetween for conformingly receiving an associated handle 36 of the lineman pliers 32.

Specific Configuration of the Illuminating Assembly 42

The specific configuration of the illuminating assembly 42 can best be seen in FIGS. 6 and 10-13, and as such, will be discussed with reference thereto.

The illuminating assembly 42 comprises a pair of housings 52. Each housing 52 of the illuminating assembly 42 is disposed substantially adjacent to the pivot point 39 of the lineman pliers 32, and is shaped similar to that of an ear.

Each housing 52 of the illuminating assembly 42 has a compartment 54 and a mount 56. The mount 56 of each housing 52 of the illuminating assembly 42 depends from the compartment 54 of an associated housing 52 of the illuminating assembly 42.

The mount 56 of each housing 52 of the illuminating assembly 42 contains a sleeve 58. The sleeve 58 of the mount 56 of an associated housing 52 of the illuminating assembly 42 extends axial there through and communicates with the sleeve 50 of an associated grip 44 of the mounting assembly 40.

Each housing 52 of the illuminating assembly 42 has an upper LED bore 60 for aiming towards the work area 34 of the lineman pliers 32, a side switch bore 62, and a front battery bore 64.

The compartment 54 of each housing 52 of the illuminating assembly 42 contains an LED 66. The LED 66 of the compartment 54 of each housing 52 of the illuminating assembly 42 is a white HiBrite LED.

The LED 66 of the compartment 54 of each housing 52 of the illuminating assembly 42 sits in the upper LED bore 60 of an associated housing 52 of the illuminating assembly 42 for aiming towards the work area 34 of the lineman pliers 32.

The compartment 54 of each housing 52 of the illuminating assembly 42 further contains a power source interface 68. The power source interface 68 of the compartment 54 of each housing 52 of the illuminating assembly 42 is in electrical communication with the LED 66 of the compartment 54 of an associated housing 52 of the illuminating assembly 42, and is for receiving a battery 70 for selectively powering the LED 66 of the compartment 54 of the associated housing 52 of the illuminating assembly 42. The battery 70 of the compartment 54 of each housing 52 of the illuminating assembly 42 is three in number, are button cell batteries, and are rated at 1.5v/25-35 mah.

The compartment 54 of each housing 52 of the illuminating assembly 42 further contains a switch 72. The switch 72 of the compartment 54 of each housing 52 of the illuminating assembly 42 sits in the side switch bore 62 of an associated housing 52 of the illuminating assembly 42, and is in electrical communication with, and selectively illuminates, the LED 66 of the compartment 54 of the associated housing 52 of the illuminating assembly 42, and is in electrical communication with the power source interface 68 of the compartment 54 of the associated housing 52 of the illuminating assembly 42.

The compartment 54 of each housing 52 of the illuminating assembly 42 further contains a snap plate 74. The snap plate 74 of the compartment 54 of each housing 52 of the illuminating assembly 42 holds the switch 72 of the compartment 54 of an associated housing 52 of the illuminating assembly 42 one of open and closed.

The compartment 54 of each housing 52 of the illuminating assembly 42 further contains a lens cover 76. The lens cover 76 of the compartment 54 of each housing 52 of the illuminating assembly 42 covers the upper LED bore 60 of an associated housing 52 of the illuminating assembly 42, and protects the LED 66 of the compartment 54 of the associated housing 52 of the illuminating assembly 42.

The compartment 54 of each housing 52 of the illuminating assembly 42 further contains a battery plate 78. The battery plate 78 of the compartment 54 of each housing 52 of the illuminating assembly 42 selectively closes the front battery bore 64 of an associated housing 52 of the illuminating assembly 42.

Impressions

It will be understood that each of the elements described above, or two or more together, may also find a useful application in other types of constructions differing from the types described above.

While the embodiments of the present invention have been illustrated and described as embodied in an illuminating device of embodiments of present invention for replaceably attaching to lineman pliers used in work area and for selectively illuminating the work area of lineman pliers, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An illuminating device for replaceably attaching to a lineman pliers used in a work area and for selectively illuminating the work area of the lineman pliers, wherein the lineman pliers include a pair of opposing handles, a pair of opposing jaws, and a pivot, and wherein said illuminating device comprising:

a) a mounting assembly; and b) an illuminating assembly;

wherein said mounting assembly is for replaceably receiving the pair of opposing handles of the lineman pliers;

wherein said illuminating assembly is integrally attached to said mounting assembly; and wherein said illuminating assembly is for selectively illuminating the work area of the lineman pliers.

2. The illuminating device of claim 1, wherein said mounting assembly comprises a pair of grips; and wherein each grip of said mounting assembly is slender and elongated for conformingly fitting when an associated handle of the lineman pliers is received thereby.

3. The illuminating device of claim 2, wherein each grip of said mounting assembly has:

a) an outside portion; and b) an inside portion; and wherein said outside portion of each grip of said mounting assembly an said inside portion of an associated grip of said mounting assembly are made from ABS rubber.

4. The illuminating device of claim 3, wherein said outside portion of each grip of said mounting assembly is attached to said inside portion of an associated grip of said mounting assembly by glue so as to form a sleeve therebetween; and wherein said sleeve of each grip of said mounting assembly is for conformingly receiving an associated handle of the lineman pliers.

5. The illuminating device of claim 3, wherein said outside portion of each grip of said mounting assembly is attached to said inside portion of an associated grip of said mounting assembly by glue, and in so doing, forms said sleeve of said associated grip of said mounting assembly.

6. The illuminating device of claim 1, wherein said illuminating assembly comprises a pair of housings; and wherein each housing of said illuminating assembly is for disposing substantially adjacent to the pivot point of the lineman pliers, and is shaped similar to that of an ear.

7. The illuminating device of claim 6, wherein each housing of said illuminating assembly has:

a) a compartment; and b) a mount.

8. The illuminating device of claim 7, wherein each mount of each housing of said illuminating assembly depends from said compartment of an associated housing of said illuminating assembly.

9. The illuminating device of claim 7, wherein said mount of each housing of said illuminating assembly contains a sleeve; and wherein said sleeve of said mount of each housing of said illuminating assembly extends axial there through and communicates with said sleeve of an associated grip of said mounting assembly.

10. The illuminating device of claim 7, wherein each housing of said illuminating assembly has:

a) an upper LED bore for aiming towards the work area of the lineman pliers;

b) a side switch bore; and c) a front battery bore.

11. The illuminating device of claim 10, wherein said compartment of each housing of said illuminating assembly contains an LED;

wherein said LED of said compartment of each housing of said illuminating assembly is a white HiBrite LED; and wherein said LED of said compartment of each housing of said illuminating assembly sits in said upper LED bore of an associated housing of said illuminating assembly for aiming towards the work area of the lineman pliers.

12. The illuminating device of claim 11, wherein said compartment of each housing of said illuminating assembly contains a power source interface; and wherein said power source interface of said compartment of each housing of said illuminating assembly is in electrical communication with said LED of said compartment of an associated housing of said illuminating assembly;

wherein the power source interface of said compartment of each housing of said illuminating assembly is for receiving a battery for selectively powering said LED of said compartment of an associated housing of said illuminating assembly; and wherein said battery of said compartment of each housing of said illuminating assembly is a 1.5v/25-35 mah button cell battery.

13. The illuminating device of claim 12, wherein said compartment of each housing of said illuminating assembly contains a switch;

wherein said switch of said compartment of each housing of said illuminating assembly sits in said side switch bore of an associated housing of said illuminating assembly; and wherein said switch of said compartment of each housing of said illuminating assembly is in electrical communication with, and selectively illuminates, said LED of said compartment of said associated housing of said illuminating assembly, and is in electrical communication with said power source interface of said compartment of said associated housing of said illuminating assembly.

14. The illuminating device of claim 13, wherein said compartment of each housing of said illuminating assembly contains a snap plate; and wherein said snap plate of said compartment of an associated housing of said illuminating assembly holds said switch of said compartment of said associated housing of said illuminating assembly one of open and closed.

15. The illuminating device of claim 10, wherein said compartment of each housing of said illuminating assembly contains a lens cover; and wherein said lens cover of said compartment of each housing of said illuminating assembly covers said upper LED bore of an associated housing of said illuminating assembly, and in so doing, protects said LED of said compartment of said associated housing of said illuminating assembly.

16. The illuminating device of claim 10, wherein said compartment of each housing of said illuminating assembly contains a battery plate; and wherein said battery plate of said compartment of each housing of said illuminating assembly selectively closes said front battery bore of an associated housing of said illuminating assembly.

* * * * *